US007073411B2

(12) United States Patent
Primrose et al.

(10) Patent No.: US 7,073,411 B2
(45) Date of Patent: Jul. 11, 2006

(54) TORSION SPRING TENSIONING APPARATUS

(76) Inventors: Fred Primrose, 10820-106 Street, Westlock, Alberta (CA) T7P 1E4; Emile deChamplain, Box 40, Rochester, Alberta (CA) T0G 1Z0

( * ) Notice: Subject to any disclaimer, the term of this patent is extended or adjusted under 35 U.S.C. 154(b) by 0 days.

(21) Appl. No.: 11/245,117

(22) Filed: Oct. 7, 2005

(65) Prior Publication Data

US 2006/0032340 A1 Feb. 16, 2006

Related U.S. Application Data

(63) Continuation-in-part of application No. 10/662,366, filed on Sep. 16, 2003.

(51) Int. Cl.
*B25B 13/00* (2006.01)

(52) U.S. Cl. ..... 81/58.2; 81/60; 81/63.2; 81/488

(58) Field of Classification Search ..... 81/58.2, 81/60, 63.2, 488
See application file for complete search history.

(56) References Cited

U.S. PATENT DOCUMENTS 3,651,719 A * 3/1972 Wessel ..... 81/63.2
3,979,977 A * 9/1976 Dorma ..... 81/57.13
5,605,079 A * 2/1997 Way ..... 81/61

* cited by examiner

*Primary Examiner*—Joseph J. Hail, III
*Assistant Examiner*—Shantese McDonald
(74) *Attorney, Agent, or Firm*—Donald V. Tomkins

(57) ABSTRACT

Apparatus for tensioning torsion spring, shaft-mounted in association with a spring cone, has a central ratchet assembly with two spaced, cogged ratchet wheels, slotted to allow the assembly to be rotatably positioned over the shaft. The ratchet assembly is connectable to the spring cone so that the spring cone will rotate with the ratchet assembly. The ratchet wheel slots are closed off by cogged bridging elements that create a continuous cogged perimeter around each ratchet wheel. Pawl-equipped levers are positioned over the ratchet wheels with the pawls engageably aligned with the ratchet wheel cogs, and then operated in alternating fashion to rotate the ratchet assembly and spring cone, thus tensioning the spring. Upon achieving a desired spring tension, the spring cone may be secured to the shaft, whereupon the bridging elements may be retracted from the ratchet wheel slots to permit removal of the apparatus from the shaft.

27 Claims, 11 Drawing Sheets

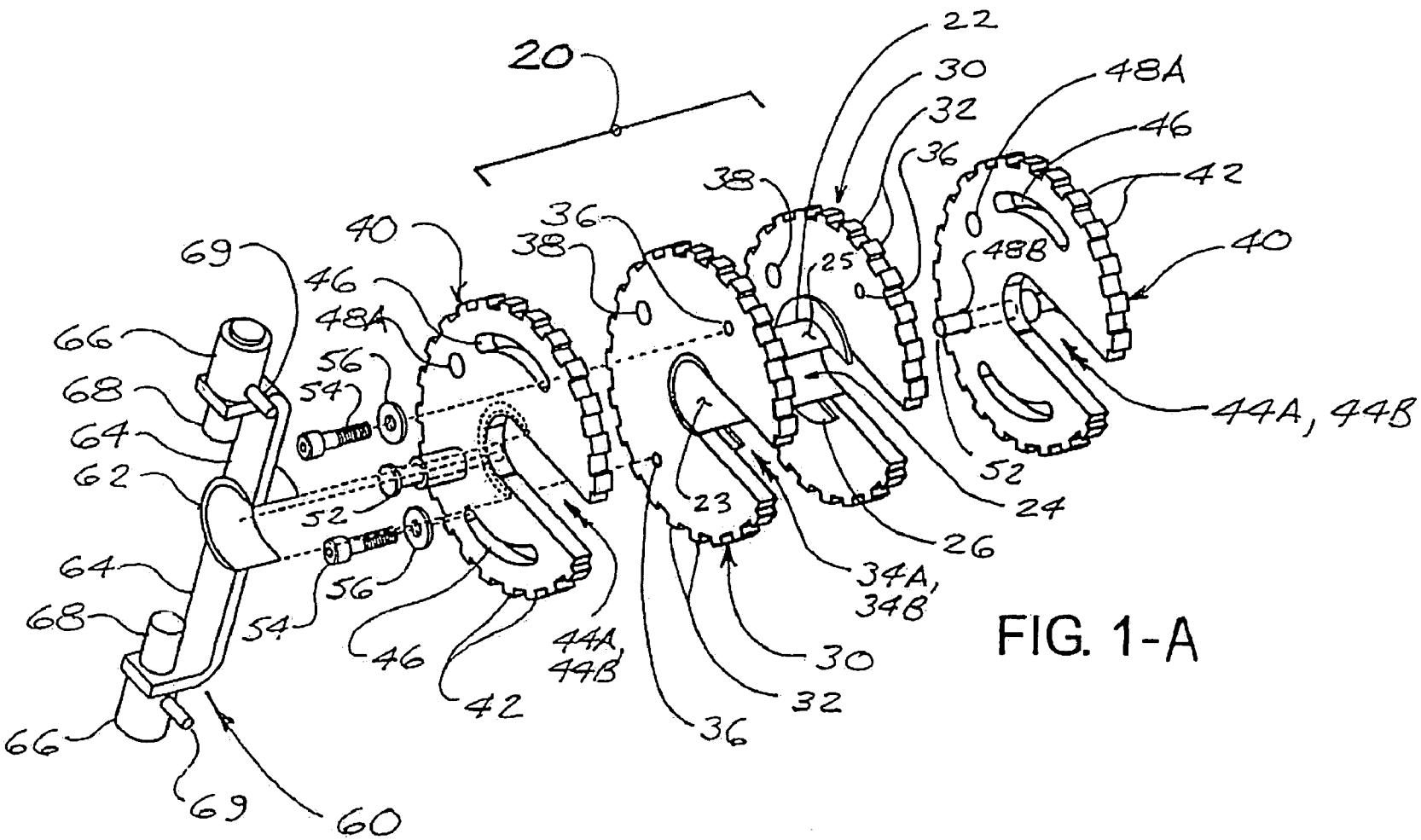
FIG. 1-A

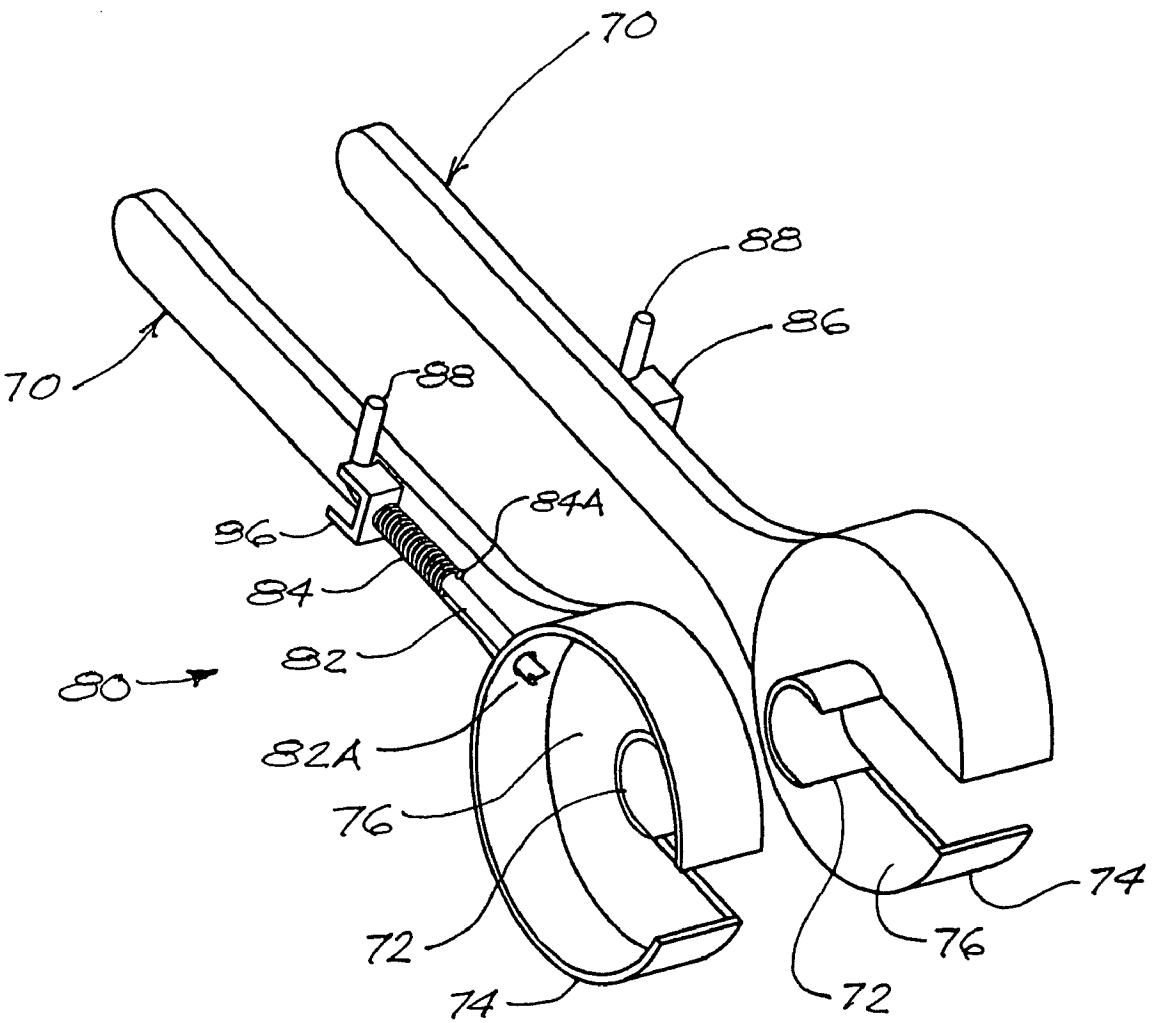
FIG. 1-B

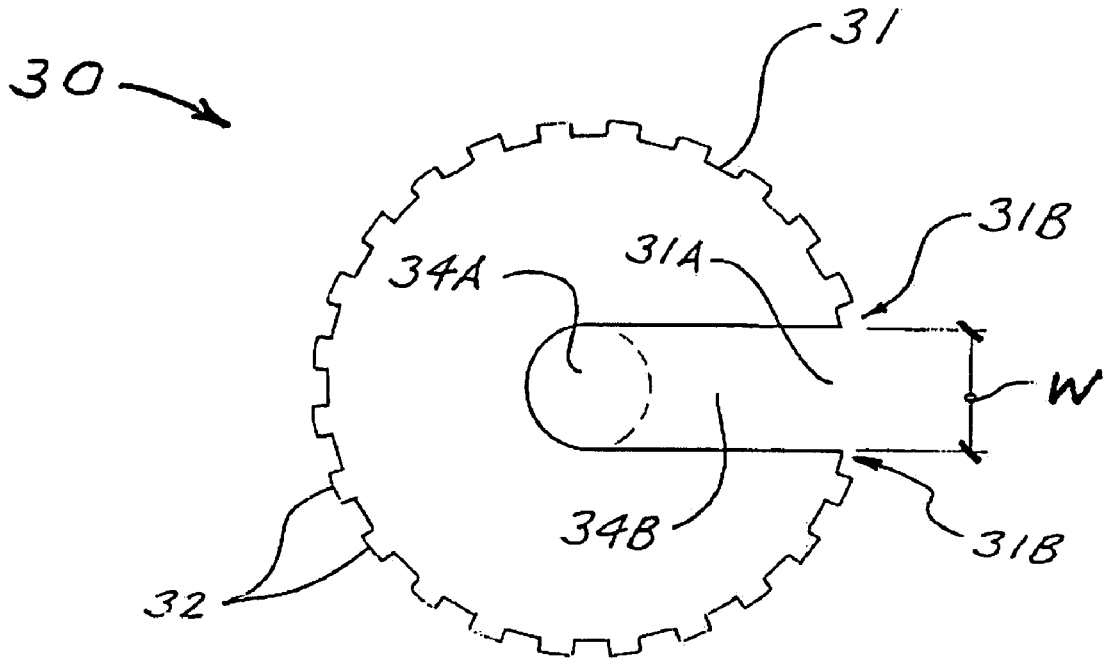
FIG. 1-C

TORSION SPRING TENSIONING APPARATUS

CROSS-REFERENCE TO RELATED APPLICATIONS

This application is a continuation-in-part of application Ser. No. 10/662,366 filed Sep. 16, 2003, and the disclosure of said earlier application is fully incorporated herein by reference.

FIELD OF THE INVENTION

The present invention relates to apparatus for tensioning shaft-mounted helical springs, and in particular for tensioning shaft-mounted torsion springs of overhead doors.

BACKGROUND OF THE INVENTION

Sectional overhead doors for residential and commercial garages typically have a number of hinged horizontal sections with rollers at each end that run inside tracks extending vertically on each side of the door opening. The tracks continue either vertically or, perhaps most commonly, horizontally inward above the door opening to accommodate the door when in its open position. These doors commonly incorporate a counterweighting system to reduce the effective door weight that must be lifted by a manual or motorized door-opening mechanism.

The components of a typical counterweighting system include an elongate round shaft with a pulley at each end, and at least one helical torsion spring mounted generally concentrically on the shaft. The shaft is rotatably mounted to the building structure above and parallel to the door opening. Each pulley has a door-lifting cable attached to the door at a selected point, typically near the bottom of the door. One end of the spring is non-rotatably fixed to the building structure, and the other end is fixed to a spring cone which in turn is lockably mounted onto the shaft (typically by means of set screws). The spring may be tensioned by rotating the spring cone around the shaft and then locking the spring cone on the shaft. The tensioned spring exerts a rotational force on the shaft, inducing tension forces in the cables, which in turn exert upward forces on the door. These upward forces effectively counteract and reduce the weight that needs to be lifted when operating the door.

There are many known types of spring cones, most of which incorporate a number of radial sockets (typically four) into which steel winding rods can be inserted for purposes of winding the spring cone around the shaft to tension the spring. With the spring cone loose on the shaft, a first rod is inserted into one socket and manual force is applied to the rod to rotate the spring cone and one end of the spring a partial turn, thus increasing spring tension. With the first rod being firmly held (to restrain spring tension), a second rod is inserted into another socket and used to turn the cone further. With the second rod being firmly held, the first rod may be withdrawn and moved to a new socket. This alternating process is continued until a desired spring tension has been achieved, whereupon the spring cone is tightened onto the shaft and the rods are removed from the sockets.

This well-known procedure is effective but potentially dangerous. If the rods are accidentally let go of while the spring cone is loose on the shaft, the tensioned spring will quickly unwind, causing the spring cone to spin on the shaft. If one or both rods are still engaged in spring cone sockets, they will spin rapidly with the spring cone and thus may injure a person standing too close. In fact, the rods may even fly out of the spring cone and thus become dangerous projectiles that can seriously injure or even kill a bystander. The danger inherent in such situations is greater for larger and heavier doors, which typically have heavier springs that store greater potential energy when tensioned.

These risks are particularly great when spring tensioning is being attempted by a single worker. Muscle fatigue and momentary inattention or distraction are only two factors that could cause the worker to lose hold of the winding rods. In view of these concerns, it is less dangerous if the spring tensioning procedure is performed by two workers, each operating only one winding rod. Then if one worker becomes unexpectedly tired or inattentive and loses control of one rod, the other worker will in most cases be holding the other rod safely, and preventing the spring from unwinding. An obvious disadvantage of this safer alternative procedure, however, is that the need for two workers results in higher cost for the spring tensioning operation.

For the foregoing reasons, it is desirable to have spring tensioning methods and means that do not use loose winding rods that can cause injury in case of inadvertent and uncontrolled unwinding of a tensioned spring, and, further, that can be safely by only one worker. The prior art discloses a number of attempts to address this problem. U.S. Pat. No. 2,718,282 (Davis), discloses spring tensioning apparatus having a splined cylindrical member with a longitudinal slot to permit mounting of the member over a spring shaft. The slot is then closed off using a secondary member that slides into longitudinal keyways in the cylindrical member on either side of the slot. The secondary member is also splined so as to create an effectively continuous splined perimeter around the cylindrical member when the secondary member has been positioned in the slot. The cylindrical member has means for connecting to a spring cone so that the spring cone will rotate when the cylindrical member is rotated. Also provided is a pair of pawl-equipped ratchet levers, each having a cylindrical inner surface and an opening to allow positioning over the shaft. The levers are placed over the shaft and slid over the splined cylindrical member, whereupon they may be operated in alternating fashion, with the pawls of the levers engaging the splines of the cylindrical member and causing it to rotate, thus rotating the spring cone and tightening the spring. Because the shaft openings in the levers are smaller than the diameter of the cylindrical member, the levers cannot come free of the cylindrical member without sliding them laterally off of the cylindrical member.

Although being a useful device, the Davis apparatus has several disadvantages. For example, it requires precise machining for splining of the cylindrical and secondary members, as well as for the keyways in the cylindrical member and the corresponding keys of the secondary member. Indeed, if the keyways are not machined to close tolerances, the secondary member will either fit too tightly (thus being difficult to install and remove) or it will be too loose (thus being prone to sliding out of the cylindrical member, making the apparatus inoperable. Even when these parts have been machined to provide an optimal fit, their mating surfaces can become damaged or covered with grime, paint, or other contaminants, in each case making insertion and/or removal of the secondary member difficult or impossible. Furthermore, the secondary member is of necessity a loose component that could be accidentally lost, again making the apparatus unusable.

U.S. Pat. No. 3,651,719 (Wessel) discloses another spring tensioning apparatus that operates on the ratchet principle.

This apparatus features an hinged split collar assembly releasably mountable around a spring cone, with a rigid pin that goes into one of the spring cone sockets so that rotation of the collar will cause rotation of the spring cone. The split collar has rounded ratchet teeth around its perimeter, the teeth extending across the full width of the inner collar. The apparatus includes a pair of pawled ratchet handles, each with a hinged split collar section approximately half the width of the toothed inner collar. The Wessel apparatus is operated by opening the inner collar and mounting it to the spring cone, closing the inner collar and locking its hinged sections with an anchor pin, opening the ratchet handle collars of the ratchet handles and placing them over the inner collar, closing the ratchet handle collars and locking their hinged sections together with anchor pins, and, finally, operating the handles in alternating fashion to tighten the spring.

The Wessel apparatus also has disadvantages and drawbacks. Its installation requires the use of three anchor pins, and the loss of even one of these loose components may make the apparatus unusable. It also has several hinges that are prone to wear and breakage that could make efficient use of the apparatus difficult or impossible. Furthermore, installation of the Wessel apparatus on the spring shaft involves a number of steps before it is ready to operate, and these steps must also be performed in reverse in order to remove the apparatus from the shaft after the spring has been tensioned. This comparatively labour-intensive procedure increases the cost of spring tensioning.

Another ratchet-type spring tensioning device is found in U.S. Pat. No. 5,605,079 (Way). This apparatus has a split housing, which is separable for installation onto the shaft and the spring cone, with a bore for receiving the shaft and a number of pins for engaging holes in the winding cone. A split sprocket is integrally mounted to the housing and an annular groove on each side of the sprocket receives a ratchet tool. The ratchet tools are locked into the groove using bolts to prevent disengagement, and are operated in alternating fashion to rotate the sprocket, thus rotating the spring cone to adjust the tension in the spring. Disadvantages of this system include the number of loose components and the higher degree of assembly and disassembly required (i.e. assembly of the split housing and sprocket, attachment of the ratchet tools, and the corresponding disassembly once the adjustment is completed).

In view of the disadvantages of the prior art devices described above, there is a need for an improved apparatus for adjusting the tension of a helically wound torsion spring that has minimal or no small loose components prone to being misplaced, that has minimal hinged components prone to wear and disrepair, and that is simple to attach to and remove from a spring shaft, while being safely operable by a single worker. The present invention is directed to these needs.

BRIEF SUMMARY OF THE INVENTION

In general terms, the invention is an apparatus for safely tensioning a torsion spring, without need for spring cone tightening rods that may pose an injury hazard in the event of an inadvertent release of spring tension during the tensioning operation. The apparatus features a central ratchet assembly with cogged ratchet wheels at each end, slotted to allow the assembly to be placed over the spring shaft adjacent to the spring cone. The ratchet assembly includes sub-apparatus connectable to the spring cone so that the spring cone (and therefore the spring) will rotate when the ratchet assembly is rotated. The slots in the ratchet wheels are closed by cogged bridging elements to create a continuously cogged perimeter around the ratchet wheels. The apparatus includes a pair of pawl-equipped operating levers that may be positioned over the ratchet wheels so that the pawls can engage the ratchet wheel cogs. The levers may then be operated in alternating fashion to rotate the ratchet assembly, thus tensioning the spring.

Accordingly, in one aspect the present invention is an apparatus for tensioning a helical spring mounted generally concentrically on an elongate round shaft having a shaft diameter, said spring having a first end fixed to a building support and a second end anchored to a spring cone lockably mounted on the shaft, said apparatus comprising:

(a) a ratchet wheel assembly comprising:
  - a.1 a trunnion having a substantially semi-cylindrical inner surface with a diameter slightly greater than the shaft diameter, and having a concentrically semi-cylindrical outer surface defining an open side; and
  - a.2 a pair of primary ratchet wheels, each having a centroidal opening, plus a radial slot contiguous with the centroidal opening and having two slot edges, said radial slot extending radially from the centroidal opening to the wheel's perimeter so as to intersect with and define a gap in said perimeter;

wherein:
  - a.3 the centroidal opening of each primary ratchet wheel is large enough to allow the shaft to be disposed therewithin, and concentrically with the primary ratchet wheel;
  - a.4 the width of each radial slot is at least slightly greater than the shaft diameter;
  - a.5 the perimeter of each primary ratchet wheel defines a continuous plurality of uniformly-spaced cogs between the edges of the primary ratchet wheel's perimeter gap; and
  - a.6 the primary ratchet wheels are spaced apart and coaxially mounted to the trunnion with their radial slots aligned with the open side of the trunnion, such that the ratchet wheel assembly can be positioned substantially coaxially over the shaft;

(b) a pair of bridging elements, each bridging element being associated with a corresponding one of the primary ratchet wheels; each bridging element having an arcuate-edged section defining a plurality of cogs configured and spaced to match the cogs of the corresponding primary ratchet wheel; wherein each bridging element is selectively operable between:
  - b.1 an open position, in which the arcuate-edged section is substantially clear of the perimeter gap and radial slot of the corresponding primary ratchet wheel so as to permit positioning of the ratchet wheel assembly coaxially over the shaft; and
  - b.2 an engaged position, in which the arcuate-edged section bridges the perimeter gap of the bridging element's corresponding primary ratchet wheel such that the cogs of the bridging element and the corresponding primary ratchet wheel combine to form a continuous and uniformly-spaced series of cogs;

(c) locking means, for releasably locking the bridging elements in the engaged position;

(d) spring cone engagement means, for releasably engaging the spring cone such that the spring cone will rotate with the ratchet wheel assembly; and (e) a pair of levers, each lever having a hub section rotatably mountable around the outer surface of the trunnion in association with one of the primary ratchet wheels, each lever having a pawl member with an inner end and an outer end, said inner end defining a cog-engaging surface and a non-engaging surface, each pawl member being mounted to its corresponding lever such that the pawl member may be retractably extended such that the cog-engaging surface may engage the cogs of one of the primary ratchet wheels and its corresponding bridging element;

wherein said apparatus may be substantially coaxially mounted over the shaft when the bridging elements are in the open position, whereupon:

(f) the bridging elements may be moved to, and releasably locked in, the engaged position, thereby to prevent disengagement of the apparatus from the spring shaft;

(g) the spring cone engagement means may be releasably engaged with the spring cone;

(h) the pawl members may be positioned to engage the cogs of the primary ratchet wheels in a desired orientation; and (i) with the spring cone free to rotate about the spring shaft, the levers may be cooperatively manipulated to rotate the spring cone in a desired direction around the shaft, thereby tensioning or alternatively relaxing the tension in the torsion spring, until a desired degree of tensioning has been achieved, whereupon the spring cone may be locked in position relative to the shaft, the bridging elements may be moved to the open position, and the apparatus may be disengaged from the shaft.

In the preferred embodiment, the trunnion is a semi-cylindrical sleeve. In an alternative embodiment, the trunnion may be an elongate member having separate cylindrical outer surfaces for rotatably receiving the levers.

Also in the preferred embodiment, the primary ratchet wheels are mounted at opposite ends of the trunnion. In operation of the apparatus in this embodiment, the levers are mounted onto the trunnion inboard of the primary ratchet wheels. In an alternative embodiment, the primary ratchet wheels are mounted inboard of the ends of the trunnion, such that the levers are mounted onto the trunnion outboard of the primary ratchet wheels. In a variant of this alternative embodiment, the levers may be mounted either inboard or outboard of the primary ratchet wheels.

In the preferred embodiment, each bridging element is an auxiliary ratchet wheel having substantially the same configuration and features of the primary ratchet wheels. Each auxiliary ratchet wheel is rotatably and coaxially mounted to its corresponding primary ratchet wheel, such that it is rotatable relative to the primary ratchet wheel between the open and engaged position. Unlike the primary ratchet wheels, the auxiliary ratchet wheels need not have cogs around their full perimeter, although that might be convenient or advantageous in some situations. What is important is for the auxiliary ratchet wheels to have sufficient cogs positioned so as to provide a substantially continuous series of cogs around the periphery of the combined primary/auxiliary ratchet wheel combination when in the engaged position. The cogs of the two wheels will necessarily lie in closely adjacent parallel planes, such that the cogs of both wheels are readily engageable by the pawl member of one of the levers.

Alternatively, each bridging element may be a cogged element smaller than its corresponding primary ratchet wheel, mountable thereto in either hinged or swivelling fashion so that it can either swing or swivel between the open and engaged positions. Where the bridging element is a cogged element hinged to the primary wheel, it may be adapted such that when in the engaged position its cogs will lie in the same plane as the primary wheel cogs. Alternatively, and in embodiments where the bridging element is a swivelling cogged element, its cogs will typically lie in a plane parallel to and closely adjacent to the plane of the primary wheel cogs, as in the case where the bridging elements are auxiliary ratchet wheels.

In the preferred embodiment, each lever includes pawl biasing means, for biasing the lever's pawl member inwardly toward the primary ratchet wheel on which the lever may be mounted. The pawl biasing means may comprise a spring. Also in the preferred embodiment, each lever includes pawl orientation means, for selectively orienting the cog-engaging surface of the lever's pawl member to accommodate rotation of the ratchet wheel assembly in either direction. The pawl orientation means may be a handle associated with the outer end of the pawl member.

Each lever preferably includes pawl alignment means, to facilitate positioning of the lever on the trunnion with the lever's pawl member in optimal alignment with the cogs of the corresponding primary ratchet wheel and bridging element. The pawl alignment means may comprise a guide member mounted to the hub section of the lever, with the guide member being rotatable against a rub plate mounted to the trunnion.

BRIEF DESCRIPTION OF THE DRAWINGS

Embodiments of the invention will now be described with reference to the accompanying figures, in which numerical references denote like parts, and in which:

FIG. 1A is an exploded isometric view of the ratchet wheel assembly of the preferred embodiment of the invention, in which the bridging elements are auxiliary ratchet wheels.

FIG. 1B is an isometric view of a pair of ratchet levers for use in association with the ratchet wheel assembly of the invention.

FIG. 1C is a side view of a primary ratchet wheel of the preferred embodiment, illustrating the centroidal opening and radial slot thereof.

DETAILED DESCRIPTION OF THE PREFERRED EMBODIMENT

Figure 6:
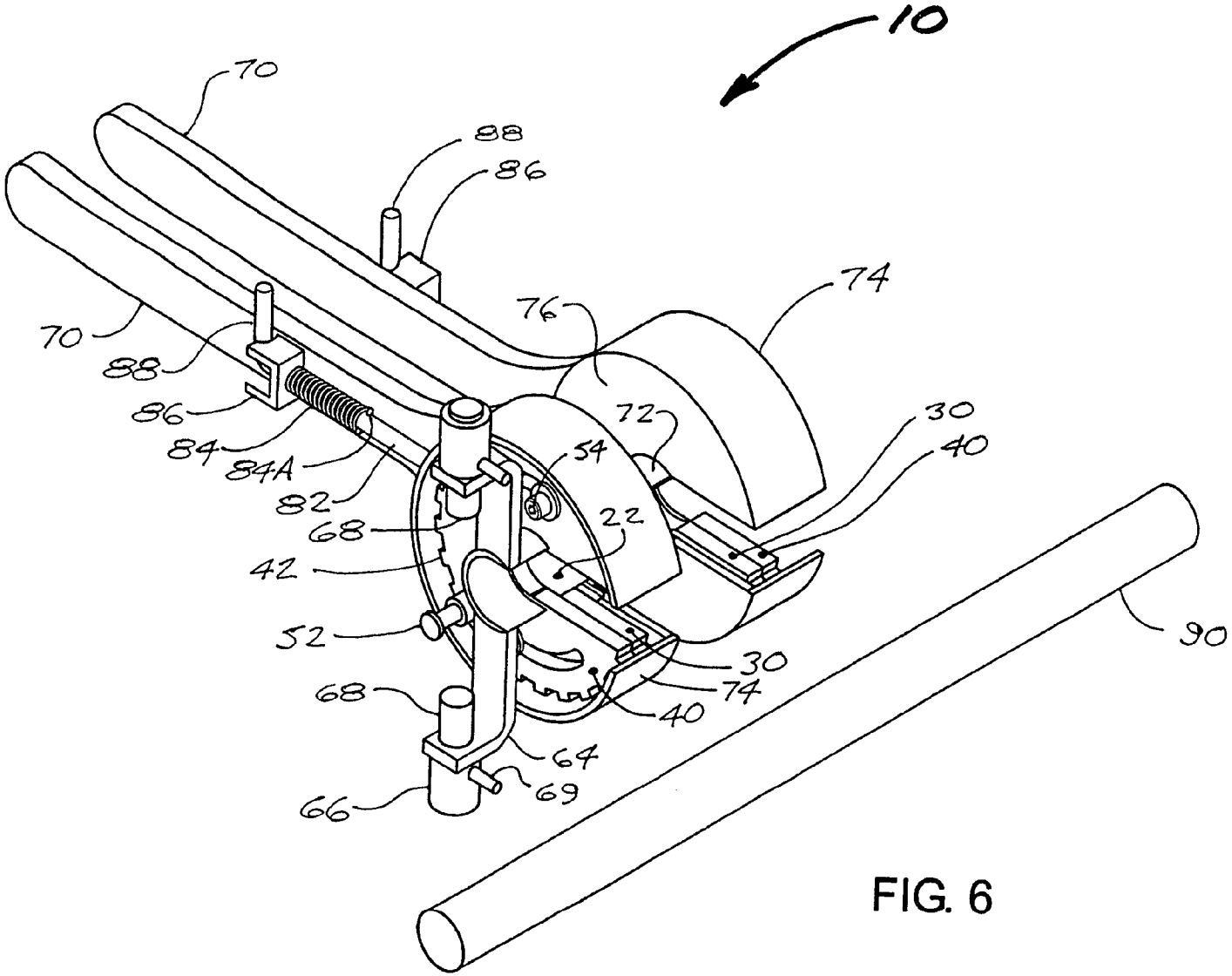
FIG. 6 is an isometric view of the fully-assembled preferred embodiment, with the auxiliary ratchet wheels in the open position and ready for mounting on a spring shaft.

The preferred embodiment of the invention, generally represented by reference numeral 10, is shown fully assembled in FIG. 6. To assist in understanding the construction of the preferred embodiment, reference may be made to FIGS. 1-A, 1-B, and 1-C, which illustrate separate components and sub-assemblies forming part of the invention 10 when fully assembled, as will be described later herein. Referring to FIG. 1-A, a ratchet wheel assembly 20 is made up of two primary ratchet wheels 30 mounted to a trunnion 22. The trunnion 22 has a semi-cylindrical inner surface 23 slightly larger in diameter than the torsion spring shaft 90 (see FIG. 6) on which it is intended to use the apparatus, such that the trunnion 22 can rotate substantially coaxially around the shaft 90. The trunnion 22 has an open side 24 of a width greater than the diameter D of the shaft 90 so as to allow the trunnion 22 to be removably positioned coaxially over the shaft 90 (as conceptually indicated in FIGS. 2 and 3). The trunnion 22 also has a cylindrical outer surface 25, for purposes that will soon be apparent. In the preferred embodiment, the trunnion 22 is a semi-cylindrical sleeve as shown in the Figures.

A pair of primary ratchet wheels 30 are fixedly and coaxially mounted to the trunnion 22 in spaced relation. In the preferred embodiment shown in FIG. 1-A, the primary ratchet wheels 30 are mounted at opposite ends of the trunnion 22; however, in alternative embodiments, either or both of the primary ratchet wheels 30 may be mounted a distance inboard from the ends of the trunnion 22.

As best understood by reference to FIG. 1-C, each primary ratchet wheel 30 has a centroidal opening 34A and a radial slot 34B, with the latter extending outward to the perimeter 31 of the primary ratchet wheel 30 and creating a perimeter gap 31A therein. As used in reference to centroidal opening 34A, the term "centroidal" indicates that centroidal opening 34A is disposed in the region of the geometric center of primary ratchet wheel 30. The perimeter of each primary ratchet wheel 30 defines a plurality of uniformly-spaced ratchet teeth, or "cogs" 32, disposed continuously around the perimeter 31 of the primary ratchet wheel 30 between the edges 31B of the perimeter gap 31A.

In the illustrated embodiments, the portion of centroidal opening 34A farthest from perimeter gap 31A is shown as having a semi-circular portion (which is concentric with the primary ratchet wheel); however, this is not essential. What is important regarding the geometrical configuration of centroidal opening 34A is that it is large enough to enclose a circular shape having a diameter equal to that of inner surface 23 of trunnion 22 (and thus will be at least slightly larger than the cross-section of shaft 90), such that there will be no interference when the assembled apparatus 10 is positioned over shaft 90. It may be preferable or convenient to fashion centroidal opening 34A with a semi-circular portion to facilitate mounting of the primary ratchet wheel 30 onto trunnion 22, particularly in embodiments where one or both of the primary ratchet wheels 30 are mounted inboard of the ends of trunnion 22. It will be appreciated, however, that centroidal opening 34A could take a different shape, subject to suitable adaptation for concentrically mounting trunnion 22 to primary ratchet wheels 30.

As will be appreciated from FIG. 1-C in particular, centroidal opening 34A and radial slot 34B are necessarily contiguous, but they are given separate reference numerals herein for ease of understanding. The radial slot 34B is shown as being of essentially constant width W, but this is not essential; what is essential is for the minimum slot width W to be greater than the diameter D of the shaft 90, so as to allow the assembly 10 to be removably positioned coaxially over shaft 90.

Also provided, in association with each primary ratchet wheel 30, is a bridging element with a cogged, arcuate-edged section, for closing off the perimeter gap in the primary ratchet wheel 30. Each bridging element is operable between:

- an "open" position, in which the radial slot 34B of the associated primary ratchet wheel 30 is clear, so as to permit mounting of the assembled apparatus 10 over the spring shaft 90, and
- an "engaged" position in which at least a portion of the bridging element spans the perimeter gap 31A of its associated primary ratchet wheel 30, such that there will be a continuous series of cogs around the full perimeter of the primary ratchet wheel 30, with the cogs of the bridging element providing the effective continuity of cogs across perimeter gap 31A.

It will be appreciated by persons skilled in the art that it is not necessary for the bridging element or any portion thereof to be disposed within perimeter gap 31A of primary ratchet wheel 30 when the bridging element is in the engaged position. In some embodiments (such as those illustrated in FIGS. 9–10), the bridging element may be at least partially disposed within the perimeter gap, such that the cogs of the bridging element are substantially aligned with (i.e., co-planar with) the cogs of primary ratchet wheel 30 when the bridging element is in the engaged position. In other embodiments (such as those illustrated in FIGS. 1-A, 7, 8, 11, and 12), the bridging element will lie adjacent to rather than in alignment with primary ratchet wheel 30 when the bridging element is in the engaged position, such that the bridging element cogs lie in a plane substantially parallel to and slightly offset from the plane of primary ratchet wheel 30.

Accordingly, the term "bridging" and related forms of this term, as used herein in association with a bridging element of the apparatus, are to be construed as denoting that the bridging element spans (i.e., bridges) perimeter gap 31A of its associated primary ratchet wheel 30 when in the engaged position, with the cogs of the bridging element being either in a substantially co-planar relationship with the cogs of the primary ratchet wheel 30, or lying in a plane parallel to and offset from the plane of the primary ratchet wheel 30.

As illustrated in FIG. 1-A and other Figures, the bridging elements in the preferred embodiment will be in the form of auxiliary ratchet wheels 40 similar in construction to the primary ratchet wheels 30, with each auxiliary ratchet wheels 40 having a corresponding centroidal opening 44A, radial slot 44B, and cogs 42. Each auxiliary ratchet wheel 40 is rotatably mounted (using suitable mounting means) to its corresponding primary ratchet wheel 30 so as to be rotatably operable between the open and engaged positions.

Figure 2:
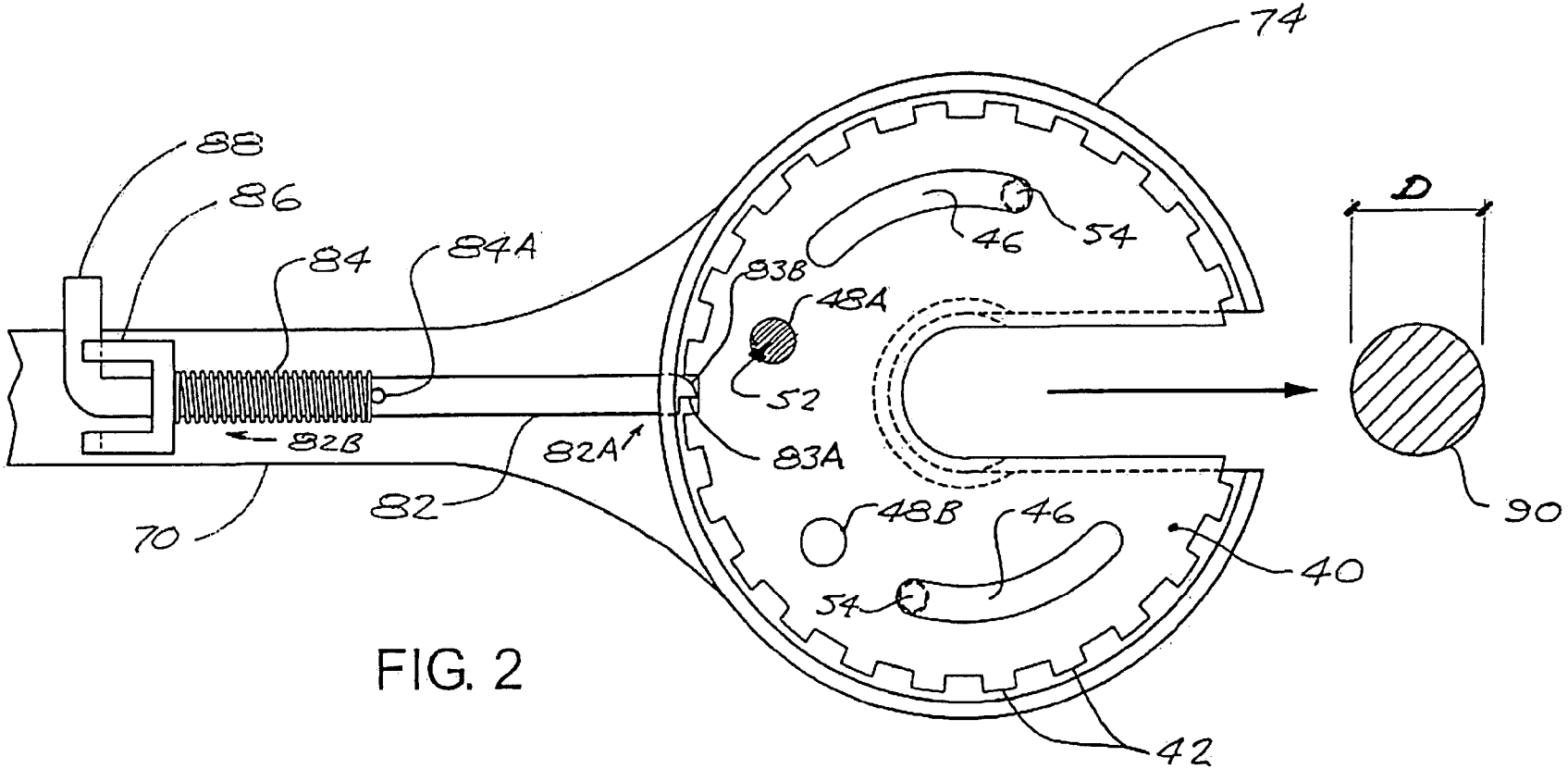
FIG. 2 is a side view of the preferred embodiment, with the auxiliary ratchet wheels in the open position, ready for mounting of the apparatus on a spring shaft.
Figure 3:
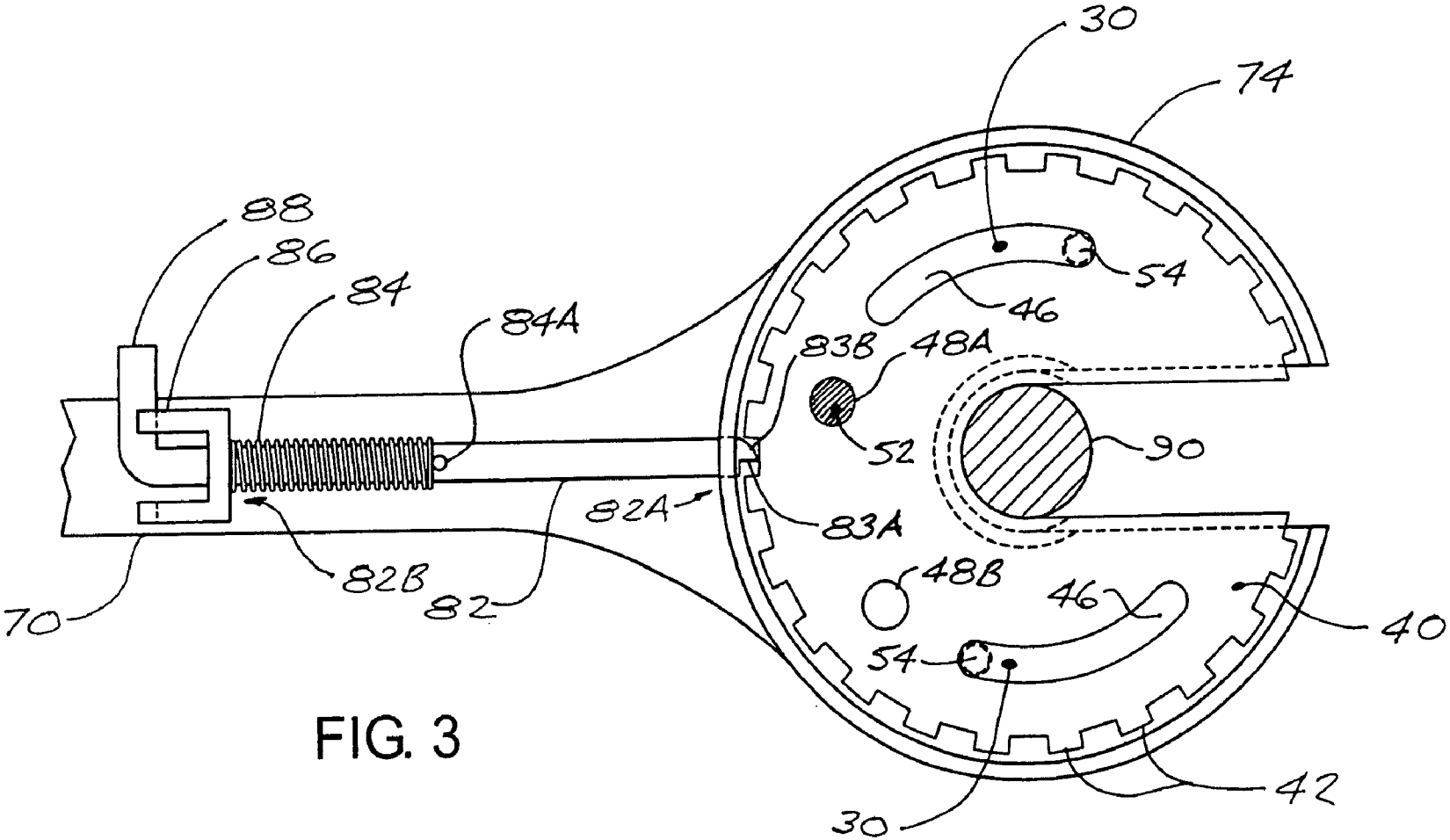
FIG. 3 is a side view of the preferred embodiment, mounted on a spring shaft with the auxiliary ratchet wheels in the open position.
Figure 4:
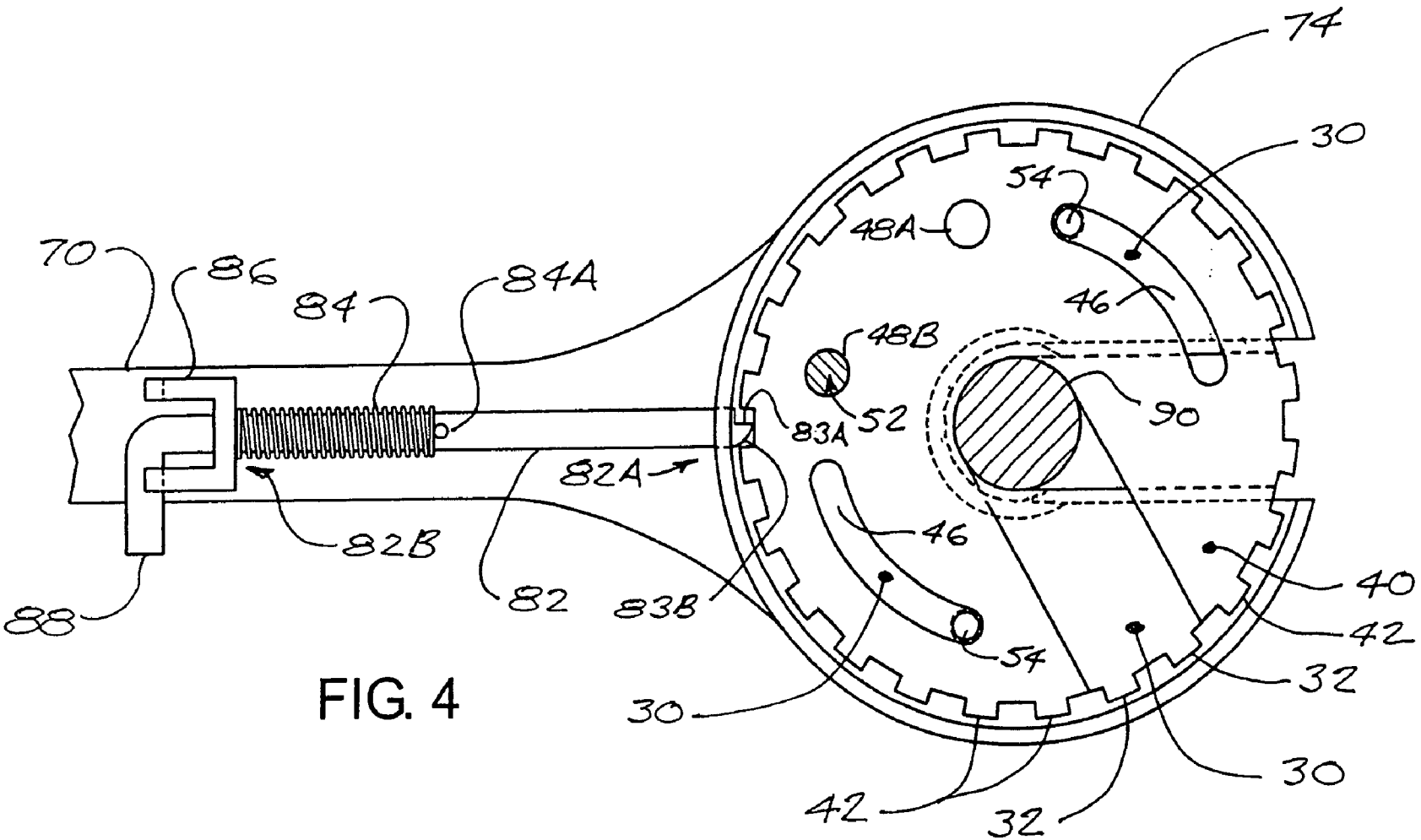
FIG. 4 is a side view of the preferred embodiment, mounted on a spring shaft with the auxiliary ratchet wheels in the engaged position.

In the preferred embodiment, as particularly illustrated in FIGS. 2, 3, and 4, the mounting means will comprise a pair of arcuate slots 46 in each auxiliary ratchet wheel 40, plus a pair of stop posts, with each stop post projecting through an associated arcuate slot 46 and anchored to the corresponding primary ratchet wheel 30. As illustrated in FIG. 1-A, the stop post may be a machine bolt 54 (with or without washer 56) which engages a mating threaded opening 36 in the corresponding primary ratchet wheel 30. However, it will be readily apparent that the stop post could take any of several other forms.

The arcuate slots 46 and stop posts are configured such that when an auxiliary ratchet wheel 40 is rotated in one direction until the stop posts hit the ends of their respective arcuate slots 46, the auxiliary ratchet wheel 40 will be in the open position, and when the auxiliary ratchet wheel 40 is rotated in the other direction until the stop posts hit the other ends of their arcuate slots 46, the auxiliary ratchet wheel 40 will be in the engaged position, with the spacing of the cogs 42 of the auxiliary ratchet wheel 40 conforming as desired with the spacing of the cogs 32 of the corresponding primary ratchet wheel 30.

Although the bridging elements of the embodiments shown in FIGS. 1-A, 2, 3, and 4 (i.e., in the form of auxiliary ratchet wheels) are shown with cogs spaced around their full perimeter, persons skilled in the field will appreciate that this is not essential. Each bridging element need only have enough cogs to span or bridge the perimeter gap 31A of its associated primary ratchet wheel 30 when the bridging element is in the engaged position. Accordingly, a bridging element in the form of an auxiliary ratchet wheel could have un-cogged perimeter except in a cogged region intended to bridge perimeter gap 31A in the engaged position. In fact, a bridging element in the form of an auxiliary ratchet wheel, in alternative embodiments, need not form a complete circular shape, provided that it has an arcuate cogged region adapted to bridge perimeter gap 31A in the corresponding primary ratchet wheel 30.

The apparatus of the invention also includes locking means, for releasably securing each bridging element in the engaged position such that cogs of the bridging element cannot be displaced relative to the cogs of the associated primary ratchet wheel 30. In the preferred embodiment, and as particularly illustrated in FIGS. 2, 3, and 4, the locking means is provided by way of a releasable pin 52 or other fastener that may be inserted through an opening 48B in the auxiliary ratchet wheel 40 into a mating opening 38 in the corresponding primary ratchet wheel 30. The pin 52 may be loose or, preferably, mounted to the auxiliary ratchet wheel 40 in spring-loaded fashion such that it will be biased to stay engaged in opening 38 when inserted therein, but may be conveniently withdrawn therefrom as desired. Although not essential to the invention, an additional opening 48A may be provided in the auxiliary ratchet wheel 40 for holding the auxiliary ratchet wheel 40 in the open position, with said opening 48A being located so as to align with opening 38 when the auxiliary ratchet wheel 40 is in the open position. It will be readily appreciated by those skilled in the art that various other locking means may be used without departing from the fundamental concept or scope of the present invention.

Figure 8:
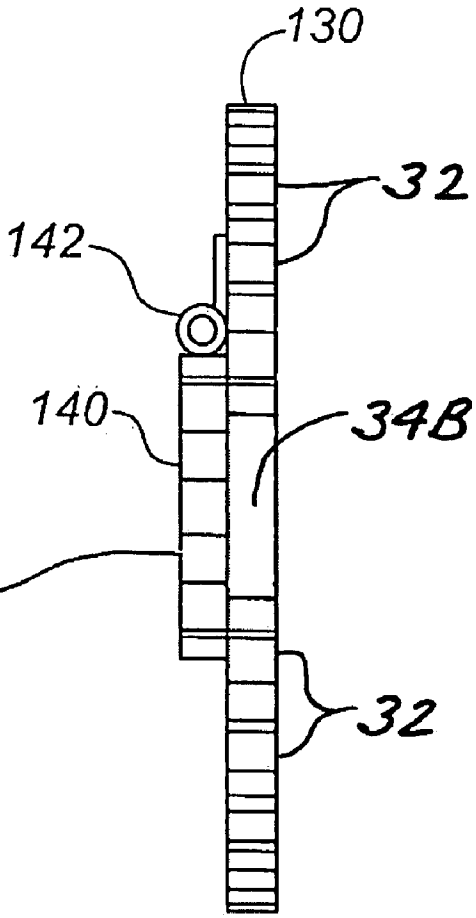
FIG. 8 is an end view of the primary ratchet wheel and bridging element shown in FIG. 7.
Figure 7:
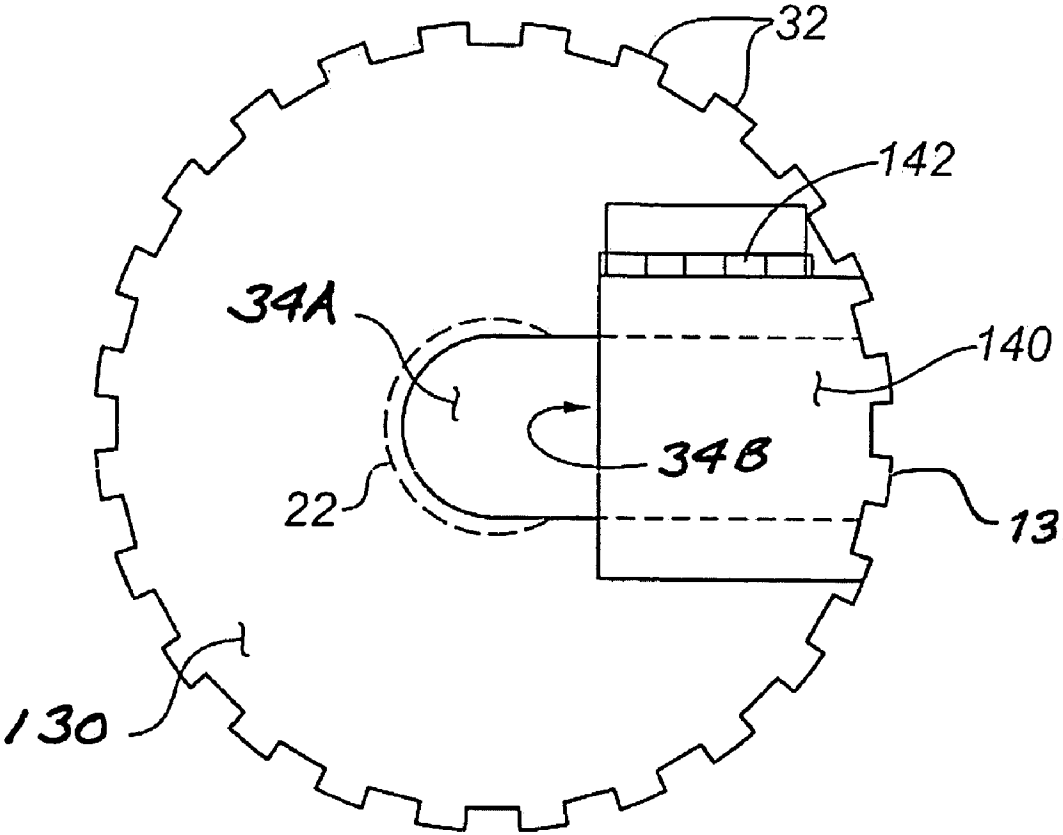
FIG. 7 is a side view of a primary ratchet wheel and bridging element in accordance with a first alternative embodiment of the invention.

In alternative embodiments, the bridging element may be a comparatively small member with a cogged, arcuate-edged section just large enough to span the perimeter gap of the corresponding primary ratchet wheel 30. In a first alternative embodiment, shown in FIGS. 7 and 8, bridging element 140, with cogs 132, is attached to modified corresponding primary ratchet wheel 130 by means of hinge 142 adjacent one edge of the radial slot 34B, such that it can swing between the engaged position (in which it will lie adjacent to the primary ratchet wheel 130) and the open position).

Figure 10:
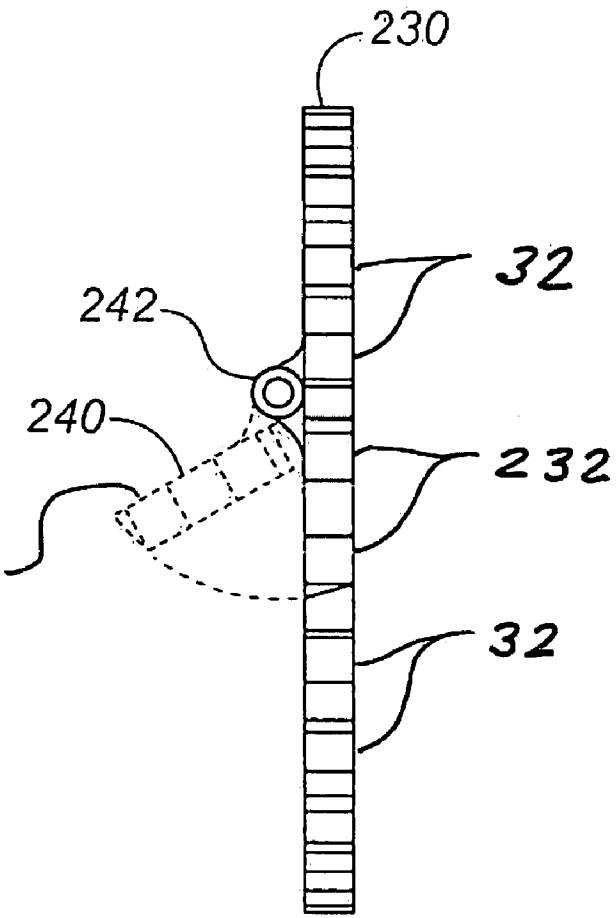
FIG. 10 is an end view of the primary ratchet wheel and bridging element shown in FIG. 9.
Figure 9:
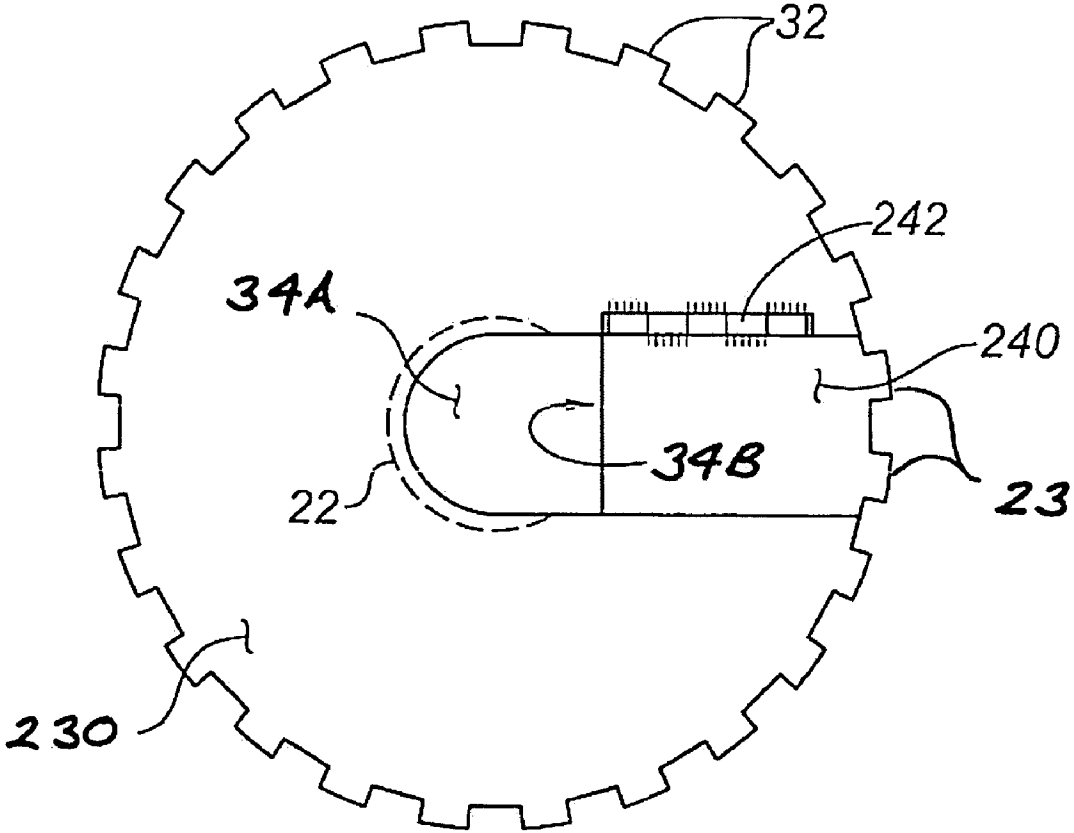
FIG. 9 is a side view of a primary ratchet wheel and bridging element in accordance with a second alternative embodiment of the invention.

In a second alternative embodiment, shown in FIGS. 9 and 10, the bridging element 240, with cogs 242, is attached to modified corresponding primary ratchet wheel 230 by means of hinge 242 adjacent one edge of the radial slot 34B, such that it will lie in substantially co-planar relation with primary ratchet wheel 230 when in the engaged position, as indicated by the solid lines in FIG. 10 (in which dotted lines also illustrate bridging element 240 in the open position).

Figure 12:
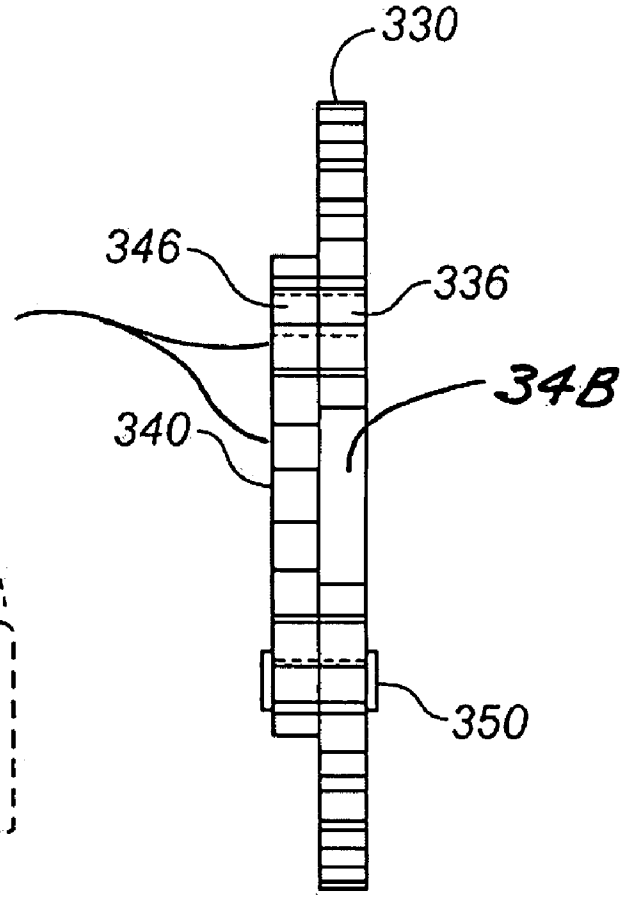
FIG. 12 is an end view of the primary ratchet wheel and bridging element shown in FIG. 11.
Figure 11:
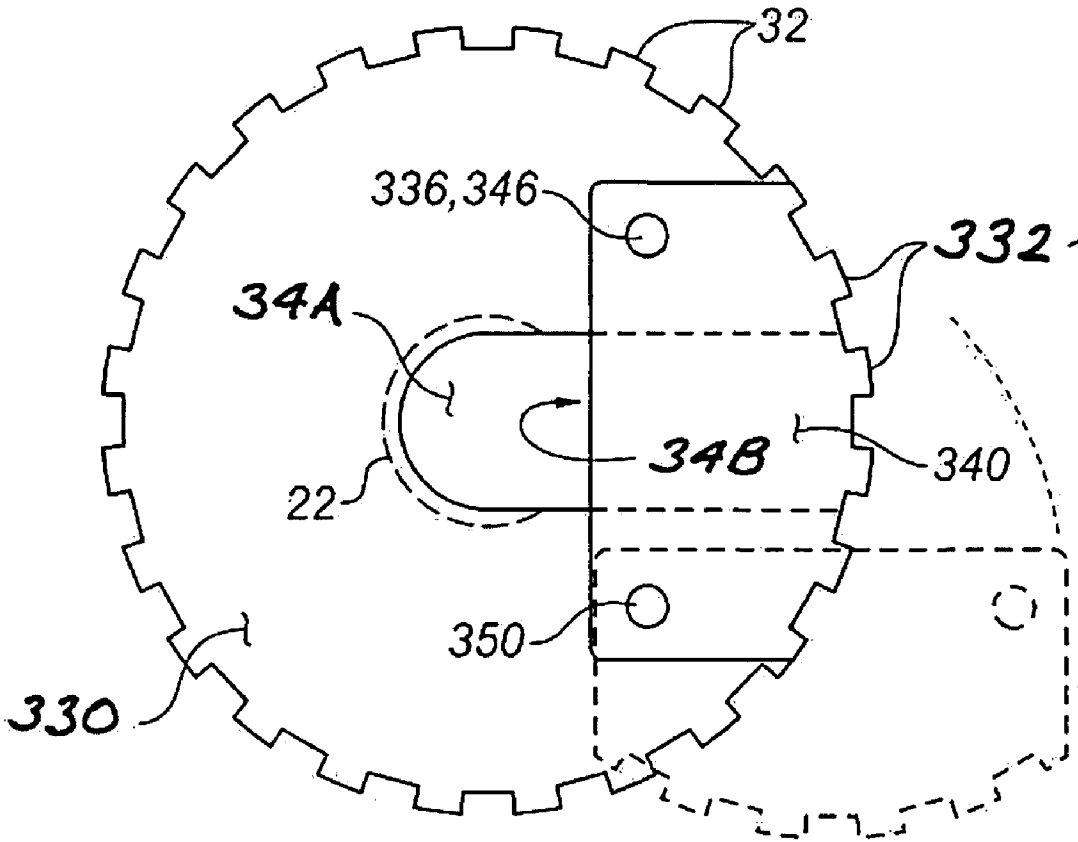
FIG. 11 is a side view of a primary ratchet wheel and bridging element in accordance with a third alternative embodiment of the invention.

In a third alternative embodiment, shown in FIGS. 11 and 12, the bridging element 340, with cogs 342, is swivellingly mounted to modified corresponding primary ratchet wheel 330 so that it swivels between the open and engaged positions about an axis parallel to the axis of the primary ratchet wheel 330 (for example, about a pivot pin 350 as illustrated). In this third embodiment, bridging element 340 may be secured in the engaged position by means analogous to the securing means previously described for the embodiment illustrated in FIG. 1-A; i.e., by providing holes 336 and 346 in primary ratchet wheel 330 and bridging element 340 respectively, through which a suitable bolt or pin may be inserted so as to releasably lock bridging element 340 in the engaged position.

In a yet further embodiment, the bridging element could take the form of a segment of an auxiliary ratchet wheel 40 as illustrated in FIGS. 3 and 4, with an arcuate slot 46 having a pair of stop posts extending therethrough, so as to allow the bridging element to rotate concentrically relative to its corresponding primary ratchet wheel 30.

Figure 5:
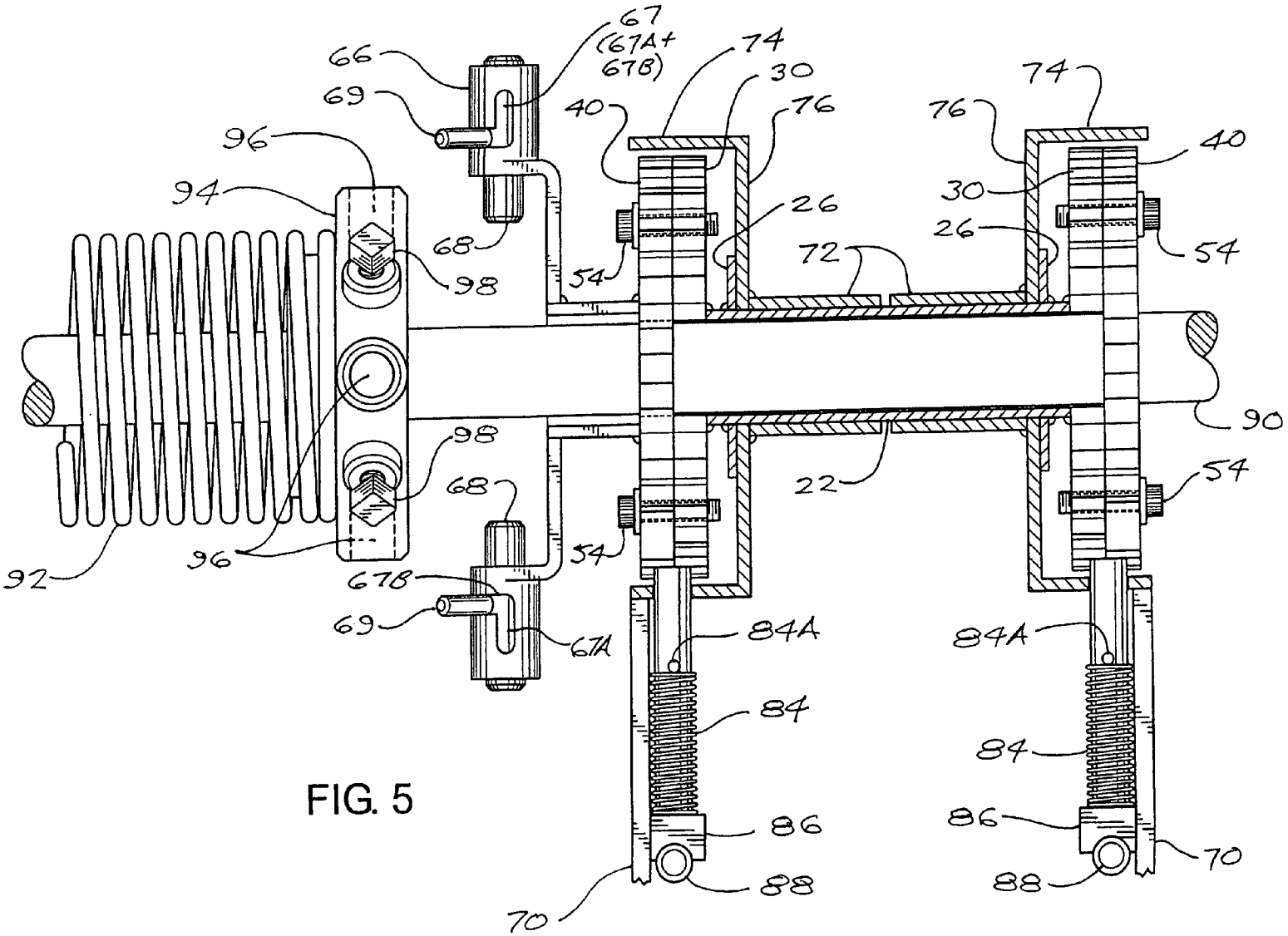
FIG. 5 is a partially-sectional elevation of the preferred embodiment, mounted on a spring shaft preparatory to engagement with the spring cone of a torsion spring.

The invention 10 also includes spring cone engagement means 60, which may take a variety of forms well known in the art of the invention. In the preferred embodiment illustrated in FIGS. 1-A, 5, and 6, the spring cone engagement means 60 has a central hub 62 and at least one outwardly-extending bracket 64 having mounted thereto a radially-oriented sleeve 66 which slidingly receives a cone-engaging pin 68 adapted to be insertable into a socket 96 of a spring cone 94. The pin 68 may be spring-loaded to bias it radially inward, such that it will tend to stay engaged in the socket 96 when engaged therein. Alternatively, and as illustrated in FIG. 5, the pin 68 may have an operating wand 69 that extends through an L-shaped slot 67 in sleeve 66, such that the pin 68 can slide within the sleeve 66 by moving the wand 69 within one leg 67A of the L-shaped slot 67 for purposes of inserting the pin 68 into the socket 96 or retracting it therefrom, and such that the pin 68 can be releasably locked in position inside the socket 96 by moving the wand 69 into the other leg 67B of the L-shaped slot 67.

The spring cone engagement means 60 is mounted to other components of the invention 10 such that it will rotate with the ratchet wheel assembly 20. In the preferred embodiment, and as particularly illustrated in FIGS. 1-A, 5, and 6, this is accomplished by rigidly connecting the spring cone engagement means 60 to one of the auxiliary ratchet wheels 40, such as by welding. In other embodiments, however, such as where the bridging elements are comparatively small and do not cover the entire surface of their associated primary ratchet wheels 30, the spring cone engagement means 60 may be mounted directly to one of the primary ratchet wheels 30.

The invention 10 also comprises a pair of ratchet levers 70, as illustrated in FIG. 1-B. Each lever 70 has a hub assembly 74 adapted to be rotatably mounted around the outer surface 25 of the trunnion 22, and for that purpose will preferably have a bushing element 72 with an inner diameter slightly greater than the diameter of the outer surface 25 of the trunnion 22. The configuration of the hub assemblies 74 as shown in the Figures is merely representative; various other hub configurations could be used without departing from the scope of the invention.

Each lever 70 also has a pawl assembly 80 comprising a pawl member 82 with an inner end 82A and an outer end 82B, with the inner end 82A defining a cog-engaging surface 83A and a non-engaging surface 83B. The pawl member 82 is mounted to the lever 70 in any suitable fashion such that its inner end 82A can be retractably extended inward toward the hub 74. In the particular embodiment shown in FIG. 1-B and FIGS. 2 through 6, the outer end 82B of the pawl member 82 passes slidably through a bracket 86 mounted to the lever 70, and the inner end 82A of the pawl member 82 passes slidably through an opening in the hub 74. In the preferred embodiment, the pawl member 82 is provided with a spring 84 (with spring retainer means 84A) or other biasing means, for biasing the pawl member 82 inward toward the hub 74.

Preferably, the pawl member 82 is also provided with pawl-orientation means, for orienting the cog-engaging surface 83A as desired, depending on the direction in which the lever 70 is to be operated. As illustrated in the Figures, the pawl-orientation means can be provided by way of a handle 88 associated with the outer end 82B of the pawl member 82. However, this is merely one example, and those skilled in the art of the invention will understand that various other pawl-orientation means could be used without departing from the concept or scope of the invention.

Assembly of the preferred embodiment of the invention 10 may now be readily understood having reference to FIGS. 5 and 6 in particular. The levers 70 are positioned between the primary ratchet wheels 30 so as to be rotatable around the outer surface 25 of the trunnion 22, with the pawl member 82 of each lever 70 aligned so as to be able to engage the cogs 32 of one of the primary ratchet wheels 30 as well as the cogs 42 of the associated auxiliary ratchet wheel 40 (or other form of bridging element) as the case may be. In the illustrated embodiment, the required alignment of the pawl members 82 is accomplished by providing rub plates 26 on the trunnion 22 and providing a guide member (typically a flat plate) 76 in association with each hub 74, with these components being configured and positioned such that the pawl members 82 will be properly aligned when the levers 70 are rotated with their guide members 76 closely adjacent their corresponding rub plates 26. Persons skilled in the art of the invention will readily appreciate that other suitable alignment means may be devised without departing from the scope of the invention.

In the illustrated embodiment, the levers 70 cannot be readily removed from the ratchet wheel assembly 20 because of the geometry of the assembly, and in particular the fact that the hubs 74 in the illustrated embodiment closely enshroud their corresponding primary ratchet wheels 30. In this arrangement, the invention 10 has no loose components that might be inadvertently misplaced. More significantly, perhaps, this arrangement prevents the levers 70 from flying loosely away from the ratchet wheel assembly in the event of an unexpected unwinding of a torsion spring being tensioned with the apparatus. However, there may be circumstances in which it will be desirable for the levers 70 to be removable, which can be easily accomplished by modifying the configuration of the hubs 74 (e.g., by making them essentially semi-circular or smaller) so that they can be mounted directly over their corresponding primary ratchet wheels 30.

The operation of the present invention may now be easily understood having particular reference to FIGS. 5 and 6. With the bridging elements in the open position, the apparatus of the invention 10 is coaxially mounted over a torsion spring shaft 90 adjacent a spring cone 94 on the side opposite the torsion spring 92 anchored thereto. The apparatus is then moved laterally as required such that the spring cone engagement means 60 can engage the spring cone 94. The bridging elements are moved to their engaged positions and locked; as preferred or convenient, this step may be taken either before or after engagement of the spring cone 94. With the spring cone 94 free to rotate about the shaft 90, with the pawl members 82 oriented as desired, and with the pawl-engaging surfaces 83A aligned to engage cogs 32 and/or 42 as the case may be, the two levers 70 may be operated with one lever 70 being used to restrain the spring 92 from unwinding while the other lever 70 is operated in typical ratchet fashion so as to rotate the spring cone engaging means 60, in turn tensioning (or relaxing the tension in) the spring 92, depending on the direction of rotation. When the spring 92 has reached the desired level of tension, the spring cone 94 may be anchored to the shaft 90 (typically by means of set screws 98 as shown in FIG. 5), whereupon the spring cone engaging means 60 may be disengaged, the bridging elements may be moved to the open position, and the apparatus may be removed from the shaft 90.

It will be readily appreciated by those skilled in the art that various modifications of the present invention may be devised without departing from the essential concept of the invention, and all such modifications are intended to be included in the scope of the claims appended hereto.

In this patent document, the word "comprising" is used in its non-limiting sense to mean that items following that word are included, but items not specifically mentioned are not excluded. A reference to an element by the indefinite article "a" does not exclude the possibility that more than one of the element is present, unless the context clearly requires that there be one and only one such element.

What is claimed is:

1. An apparatus for tensioning a helical spring mounted generally concentrically on an elongate round shaft having a shaft diameter, said spring having a first end fixed to a building support and a second end anchored to a spring cone lockably mounted on the shaft, said apparatus comprising:

(a) a ratchet wheel assembly comprising:

a.1 a trunnion having a substantially semi-cylindrical inner surface with a diameter slightly greater than the shaft diameter, and having a concentrically semi-cylindrical outer surface defining an open side; and a.2 a pair of primary ratchet wheels, each having a centroidal opening, plus a radial slot contiguous with the centroidal opening and having two slot edges, said radial slot extending radially from the centroidal opening to the wheel's perimeter so as to intersect with and define a gap in said perimeter;

wherein:

a.3 the centroidal opening of each primary ratchet wheel is large enough to allow the shaft to be disposed therewithin, and concentrically with the primary ratchet wheel;

a.4 the width of each radial slot is at least slightly greater than the shaft diameter;

a.5 the perimeter of each primary ratchet wheel defines a continuous plurality of uniformly-spaced cogs between the edges of the primary ratchet wheel's perimeter gap; and a.6 the primary ratchet wheels are spaced apart and coaxially mounted to the trunnion with their radial slots aligned with the open side of the trunnion, such that the ratchet wheel assembly can be positioned substantially coaxially over the shaft;

(b) a pair of bridging elements, each bridging element being associated with a corresponding one of the primary ratchet wheels; each bridging element having an arcuate-edged section defining a plurality of cogs configured and spaced to match the cogs of the corresponding primary ratchet wheel; wherein each bridging element is selectively operable between:

b.1 an open position, in which the arcuate-edged section is substantially clear of the perimeter gap and radial slot of the corresponding primary ratchet wheel so as to permit positioning of the ratchet wheel assembly coaxially over the shaft; and b.2 an engaged position, in which the arcuate-edged section bridges the perimeter gap of the bridging element's corresponding primary ratchet wheel such that the cogs of the bridging element and the corresponding primary ratchet wheel combine to form a continuous and uniformly-spaced series of cogs;

(c) locking means, for releasably locking the bridging elements in the engaged position;

(d) spring cone engagement means, for releasably engaging the spring cone such that the spring cone will rotate with the ratchet wheel assembly; and (e) a pair of levers, each lever having a hub section rotatably mountable around the outer surface of the trunnion in association with one of the primary ratchet wheels, each lever having a pawl member with an inner end and an outer end, said inner end defining a cog-engaging surface and a non-engaging surface, each pawl member being mounted to its corresponding lever such that the pawl member may be retractably extended such that the cog-engaging surface may engage the cogs of one of the primary ratchet wheels and its corresponding bridging element;

wherein said apparatus may be substantially coaxially mounted over the shaft when the bridging elements are in the open position, whereupon:

(f) the bridging elements may be moved to, and releasably locked in, the engaged position, thereby to prevent disengagement of the apparatus from the spring shaft;

(g) the spring cone engagement means may be releasably engaged with the spring cone;

(h) the pawl members may be positioned to engage the cogs of the primary ratchet wheels in a desired orientation; and (i) with the spring cone free to rotate about the spring shaft, the levers may be cooperatively manipulated to rotate the spring cone in a desired direction around the shaft, thereby tensioning or alternatively relaxing the tension in the torsion spring, until a desired degree of tensioning has been achieved, whereupon the spring cone may be locked in position relative to the shaft, the bridging elements may be moved to the open position, and the apparatus may be disengaged from the shaft.

2. The apparatus of claim 1 wherein the trunnion comprises a substantially semi-cylindrical sleeve.

3. The apparatus of claim 1 wherein the primary ratchet wheels are mounted at opposite ends of the trunnion, such that each lever may be rotated around the outer surface of the trunnion at a point inboard of its corresponding primary ratchet wheel.

4. The apparatus of claim 1 wherein each of the primary ratchet wheels is mounted at a point inboard of one end of the trunnion, such that each lever may be rotated around the outer surface of the trunnion at a point outboard of its corresponding primary ratchet wheel.

5. The apparatus of claim 1 wherein at least one bridging element is an auxiliary ratchet wheel having a centroidal opening plus a radial slot contiguous with the centroidal opening and extending therefrom to the auxiliary wheel's perimeter and defining a gap in the auxiliary ratchet wheel's perimeter, wherein:

(a) the centroidal opening of each auxiliary ratchet wheel is large enough to allow the shaft to be disposed therewithin;

(b) the width of the radial slot of each auxiliary ratchet wheel is at least slightly greater than the shaft diameter; and (c) the apparatus further comprises mounting means whereby the auxiliary ratchet wheel may be coaxially and rotatably connected to the corresponding primary ratchet wheel, such that the auxiliary ratchet wheel may be rotatably operated between the open and engaged positions.

6. The apparatus of claim 5 wherein, with respect to each auxiliary ratchet wheel, the mounting means comprises a pair of arcuate slots in the auxiliary ratchet wheel, plus a pair of stop posts, with each stop post projecting through an associated one of the arcuate slots and anchored to the corresponding primary ratchet wheel.

7. The apparatus of claim 5 wherein the locking means of at least one auxiliary ratchet wheel comprises a fastener removably engageable through an opening in the auxiliary ratchet wheel and a mating opening in the corresponding primary ratchet wheel.

8. The apparatus of claim 7 wherein the fastener is a bolt, and the mating opening in the primary ratchet wheel is a threaded opening.

9. The apparatus of claim 7 wherein the fastener is a pin.

10. The apparatus of claim 9 wherein the pin is a spring-loaded pin retainably mounted to the auxiliary ratchet wheel.

11. The apparatus of claim 1 wherein:

(a) at least one bridging element is hingedly mounted to its corresponding primary ratchet wheel, so as to be hingingly movable between the open and engaged positions; and (b) when the bridging element is in the engaged position, the cogs thereof lie in substantially the same plane as the cogs of the ratchet wheel.

12. The apparatus of claim 1 wherein:

(a) at least one bridging element is hingedly mounted to its corresponding primary ratchet wheel, so as to be hingingly movable between the open and engaged positions; and (b) when the bridging element is in the engaged position, the cogs thereof lie in a plane offset from the plane of the cogs of the ratchet wheel.

13. The apparatus of claim 1 wherein at least one bridging element is swivellably mounted to its corresponding primary ratchet wheel about an axis substantially parallel to the centroidal axis of the ratchet wheel, such that the bridging element is swivellably movable between the open and engaged positions.

14. The apparatus of claim 13 wherein the pawl biasing means comprises a spring.

15. The apparatus of claim 1 further comprising pawl biasing means, for biasing the pawl member inwardly.

16. The apparatus of claim 1 further comprising pawl orientation means, for selectively orienting the cog-engaging surface of the pawl member to accommodate rotation of the ratchet wheel assembly in either direction.

17. The apparatus of claim 16 wherein the pawl orientation means comprises a rotatable handle associated with the outer end of the pawl member.

18. The apparatus of claim 1 wherein the hub section of at least one lever comprises a substantially semi-cylindrical bushing element having an inner diameter slightly greater than the diameter of the outer surface of the trunnion, said bushing element being matingly and rotatably engageable with said outer surface of the trunnion.

19. The apparatus of claim 18 wherein the hub section further comprises pawl alignment means, to facilitate positioning of the hub section on the trunnion so as to align the pawl member with the cogs of one of the primary ratchet wheels and its corresponding bridging element.

20. The apparatus of claim 19 wherein:

(a) the trunnion further comprises a rub plate mounted to the trunnion adjacent one of the primary ratchet wheels, in a plane substantially perpendicular to the axis of the trunnion, said rub plate having a radial slot with a minimum width greater than the diameter of the outer surface of the trunnion, and said radial slot being substantially aligned with the open side of the trunnion; and (b) the pawl alignment means comprises a guide member positioned such that when the lever is rotated with guide member in contact with said rub plate, the pawl member will be aligned so as to be engageable with the cogs of both the primary ratchet wheel and its corresponding bridging element.

21. The apparatus of claim 20 wherein the guide member is a plate oriented substantially perpendicular to the centroidal axis of the bushing element.

22. The apparatus of claim 1 wherein the spring cone engagement means comprises a bracket having at least one sleeve oriented radially relative to the axis of the trunnion, each sleeve having a cone-engaging pin slidable within said sleeve and adapted for removable insertion into a socket of the spring cone, such that rotation of the ratchet wheel assembly with the pin inserted into the spring cone socket will induce exert a rotational force on the spring cone.

23. The apparatus of claim 22, further comprising a spring for biasing the cone-engaging pin radially inward such that upon insertion into a spring cone socket the pin will tend to remain inserted therein.

24. The apparatus of claim 22 wherein the sleeve defines an L-shaped slot having a first leg and a second leg, and wherein the cone-engaging pin has an operating wand projecting through and slidable within said slot, such that:

(a) movement of the wand within the first leg away from the intersection of the slot legs will move the pin radially outward;

(b) movement of the wand within the first leg toward said intersection will move the pin radially inward; and (c) movement of the wand with the second leg away from said intersection will substantially prevent radial movement of the pin.

25. The apparatus of claim 1 wherein the spring cone engagement means is mounted to one of the bridging elements.

26. The apparatus of claim 1 wherein the spring cone engagement means is mounted to one of the primary ratchet wheels.

27. An apparatus for tensioning a helical spring mounted generally concentrically on an elongate round shaft having a shaft diameter, said spring having a first end fixed to a building support and a second end anchored to a spring cone lockably mounted on the shaft, said apparatus comprising:

(a) a ratchet wheel assembly comprising:

a.1 a trunnion having a substantially semi-cylindrical inner surface with a diameter slightly greater than the shaft diameter, and having a concentrically semi-cylindrical outer surface defining an open side; and a.2 a pair of primary ratchet wheels, each having a centroidal opening, plus a radial slot contiguous with the centroidal opening and having two slot edges, said radial slot extending radially from the centroidal opening to the wheel's perimeter so as to intersect with and define a gap in said perimeter;

wherein:

a.3 the centroidal opening of each primary ratchet wheel is large enough to allow the shaft to be disposed therewithin, and concentrically with the primary ratchet wheel;

a.4 the width of each radial slot is at least slightly greater than the shaft diameter;

a.5 the perimeter of each primary ratchet wheel defines a continuous plurality of uniformly-spaced cogs between the edges of the primary ratchet wheel's perimeter gap; and a.6 the primary ratchet wheels are spaced apart and coaxially mounted to the trunnion with their radial slots aligned with the open side of the trunnion, such that the ratchet wheel assembly can be positioned substantially coaxially over the shaft;

(b) a pair of auxiliary ratchet wheels, each having a centroidal opening plus a radial slot contiguous with the centroidal opening and extending therefrom to the auxiliary wheel's perimeter and defining a gap in the auxiliary ratchet wheel's perimeter, wherein:

b.1 the centroidal opening of each auxiliary ratchet wheel is large enough to allow the shaft to be disposed therewithin;

b.2 the width of the radial slot of each auxiliary ratchet wheel is at least slightly greater than the shaft diameter;

b.3 the apparatus further comprises mounting means whereby each auxiliary ratchet wheel may be coaxially and rotatably connected to an associated one of the primary ratchet wheels; and b.4 each auxiliary ratchet wheel has an arcuate-edged section defining a plurality of cogs configured and spaced to match the cogs of the corresponding primary ratchet wheel wherein each auxiliary ratchet wheel is selectively operable between:

b.5 an open position, in which the arcuate-edged section is substantially clear of the perimeter gap and radial slot of the corresponding primary ratchet wheel so as to permit positioning of the ratchet wheel assembly coaxially over the shaft; and b.6 an engaged position, in which the arcuate-edged section bridges the perimeter gap of the auxiliary ratchet wheel's corresponding primary ratchet wheel such that the cogs of the auxiliary ratchet wheel and the corresponding primary ratchet wheel combine to form a continuous and uniformly-spaced series of cogs;

(c) locking means, for releasably locking the auxiliary ratchet wheels in the engaged position;

(d) spring cone engagement means, for releasably engaging the spring cone such that the spring cone will rotate with the ratchet wheel assembly; and (e) a pair of levers, each lever having a hub section rotatably mountable around the outer surface of the trunnion in association with one of the primary ratchet wheels, each lever having a pawl member with an inner end and an outer end, said inner end defining a cog-engaging surface and a non-engaging surface, each pawl member being mounted to its corresponding lever such that the pawl member may be retractably extended such that the cog-engaging surface may engage the cogs of one of the primary ratchet wheels and its corresponding auxiliary ratchet wheel;

wherein said apparatus may be substantially coaxially mounted over the shaft when the auxiliary ratchet wheels are in the open position, whereupon:

(f) the auxiliary ratchet wheels may be moved to, and releasably locked in, the engaged position, thereby to prevent disengagement of the apparatus from the spring shaft;

(g) the spring cone engagement means may be releasably engaged with the spring cone;

(h) the pawl members may be positioned to engage the cogs of the primary ratchet wheels in a desired orientation; and (i) with the spring cone free to rotate about the spring shaft, the levers may be cooperatively manipulated to rotate the spring cone in a desired direction around the shaft, thereby tensioning or alternatively relaxing the tension in the torsion spring, until a desired degree of tensioning has been achieved, whereupon the spring cone may be locked in position relative to the shaft, the auxiliary ratchet wheels may be moved to the open position, and the apparatus may be disengaged from the shaft.

* * * * *